US005936509A

United States Patent [19]

Norte et al.

[11] Patent Number: 5,936,509

[45] Date of Patent: Aug. 10, 1999

[54] CARBON-GLASS FUSE

[75] Inventors: David A. Norte; Woong K. Yoon, both of Westminster, Colo.

[73] Assignee: Lucent Technologies Inc., Murray Hill, N.J.

[21] Appl. No.: 08/943,449

[22] Filed: Oct. 3, 1997

[51] Int. Cl.[6] ..... H01H 85/06; H01H 85/08; H01H 85/055

[52] U.S. Cl. ..... 337/290; 337/241; 337/296; 337/295; 337/159

[58] Field of Search ..... 361/435, 534, 361/104, 523, 524, 529, 504, 503; 439/890, 893; 324/550; 327/525; 335/142; 340/638; 29/623

[56] References Cited

U.S. PATENT DOCUMENTS 2,556,616 6/1951 Ellis ..... 65/32.1
3,813,232 5/1974 Forker ..... 65/23
4,180,723 12/1979 Szupillo ..... 219/541

FOREIGN PATENT DOCUMENTS

4431143 A1 9/1994 Germany ..... H01T 13/20

OTHER PUBLICATIONS

Brochure Advertisement: SIGRADUR®, The Glassy Carbon from SIGRI, SGL Carbon Group Corporation, 900 Theresia Street, St. Marys, PA 15857, pp. 1–9.

*Primary Examiner*—Leo P. Picard
*Assistant Examiner*—Anatoly Vortman
*Attorney, Agent, or Firm*—David Volejnicek

[57] ABSTRACT

The fusible element of an electrical fuse is made from carbon glass. The carbon glass melts and pulls apart safely when the fuse blows, so the fusible element normally does not need an enclosure. The carbon glass glows and emits light when current flowing therethrough approaches the fuse's current-carrying capacity, thereby acting as a current sensor and a warning indicator that the fuse is about to blow.

7 Claims, 1 Drawing Sheet

CARBON-GLASS FUSE

TECHNICAL FIELD

This invention relates to electrical fuses.

BACKGROUND OF THE INVENTION

The fusible element of a typical electrical fuse consists of a strip of metal that has a chemical composition and a physical structure (e.g., cross sectional area) which cause the metal to melt or burn, and thereby cause an open circuit, when power-flow therethrough exceeds a predetermined limit. Typical fuse constructions are bulky and require the fusible element to be encapsulated within a glass or plastic enclosure in order to prevent the element from sparking into its operating environment and potentially becoming unsafe. The size of the fuse generally becomes quite large for fuses that must conduct large currents.

SUMMARY OF THE INVENTION

A technical advance in the art is achieved by using carbon glass as the fusible element in an electrical fuse. Such a fuse relies on the properties, including electrical conductivity, of carbon glass to yield a simple, safe, robust, and effective fuse. Moreover, the light-emitting property of carbon glass is preferably relied on to yield a current-sensing fuse that gives a visual indication of its impending blowing.

These and other advantages and features of the invention will become more apparent from the following description of an illustrative embodiment of the invention considered together with the drawing.

DETAILED DESCRIPTION

Figure 1:
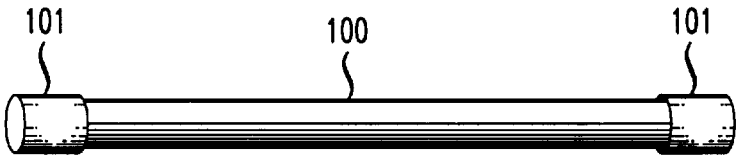
FIG. 1 is a perspective view of a fuse that implements an illustrative first embodiment of the invention.

FIG. 1 shows a fuse constructed according to the invention. It comprises a rod 100 of carbon glass having an ohmic contact 101 at each end thereof. Rod 100 functions as the fusible element of the fuse. Rod 100 is illustratively made from the SIGRADUR® material made by SIGRI of the Federal Republic of Germany, and presently available from the SGL Carbon Corporation, St. Marys, Pa., U.S.A. While rod 100 is shown in FIG. 1 to have a cylindrical shape, the physical structure of the fusible element is not restricted to a cylindrical shape; it can assume any desired shape—e.g., rectangular, tabular, spherical, stripline, or "horseshoe" (shown in FIG. 2). Ohmic contacts 101 provide electrical contact between rod 100 and external circuitry and also provide physical holds for mounting the fuse to a support (e.g., a printed circuit board). Ohmic contacts 101 illustratively comprise either metallic caps mounted over the ends of rod 100 or a metallic coating deposited on the ends of rod 100.

Carbon glass is an electrically conductive material whose power-carrying capacity is a function of its cross-sectional area orthogonal to the direction of current flow. Thus, by using carbon-glass structures having different physical dimensions, one is able to design fuses that can carry any desired current values, e.g., from milliamps to hundreds of amps. Carbon glass does not exhibit any potentially unsafe characteristics when the fuse blows, such as burning, sparking, arcing, or exploding. Rather, the material merely melts and pulls apart, thereby producing an open circuit. Consequently, the carbon-glass fuse typically does not need an enclosure for the fusible element in order to operate safely. Though, of course, such an enclosure may be provided to protect the fusible element from physical damage when the carbon-glass rod 100 is especially thin. Moreover, the insertion loss due to the fuse is quite small. For example, for a cylindrical rod having a length of 1.183 inches and a cross-sectional area of 0.019 square inches is characterized with an insertion loss of only 0.8 Ω. The insertion loss due to the frequency dependence of the carbon glass material is found to be negligible up to 1 GHz. Hence, the fuse has little or no impact on the electrical characteristics of the circuit in which it is used.

Figure 2:
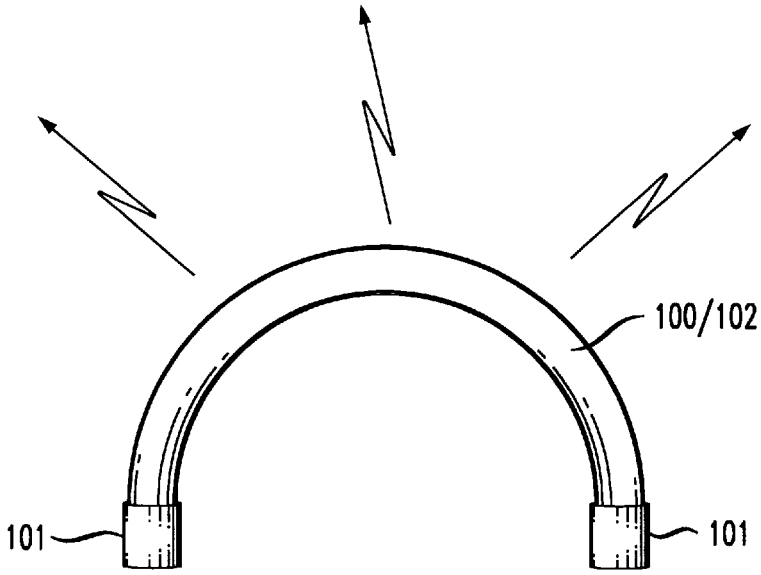
FIG. 2 is a side view of a fuse that implements an illustrative second embodiment of the invention.

Carbon-glass exhibits one other property that makes it particularly useful as a fuse: as the current flowing through the carbon-glass structure approaches the structure's current-carrying capacity, the material begins to glow and emit light. Thus, the fusible element acts as a current sensor and a warning indicator that gives a visual warning that the current through the fuse is approaching maximum capacity and the fuse is about to blow. The carbon glass thus performs double duty, as both a fusible element 100 of a fuse and a filament 102 of an alarm light. An illustrative such element is shown in FIG. 2.

Figure 3:
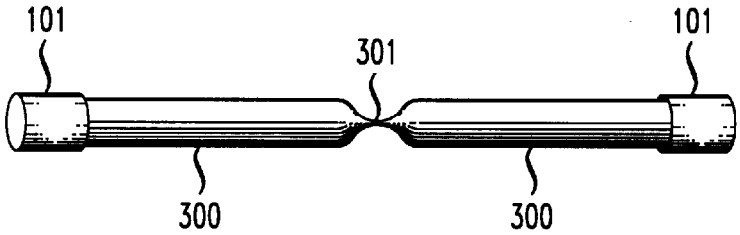
FIG. 3 is a perspective view of a fuse that implements an illustrative third embodiment of the invention.

For low-current fuses, the implementation shown in FIG. 3 is desirable. This implementation is characterized by an hourglass shape. The portions 300 of the carbon glass that have a relatively large cross-section provide structural integrity to the fuse, while the portion 301 that has a relatively small cross-section determines the current-carrying capacity of the fuse and forms a low-current fusible element.

Of course, various changes and modifications to the illustrative embodiment described above will be apparent to those skilled in the art. These changes and modifications can be made without departing from the spirit and the scope of the invention and without diminishing its attendant advantages. It is therefore intended that such changes and modifications be covered by the following claims.

What is claimed is:

1. In an electrical fuse having a fusible element, the improvement comprising:

the fusible element comprising carbon glass that glows as current passing through the fusible element approaches a limit of the fuse, thereby giving a visual indication thereof.

2. An electrical fuse comprising a fusible element comprising carbon glass that glows as current passing through the fusible element approaches a limit of the fuse, thereby giving a visual indication thereof; and a pair of ohmic contacts attached to the fusible element.

3. An electrical fuse comprising a fusible element comprising a rod of carbon glass that has a substantially hourglass shape; and a pair of ohmic contacts attached to the fusible element.

4. The electrical fuse of claim 3 wherein:

the rod of carbon glass defines opposite ends; and each ohmic contact is mounted on a different one of the ends.

5. In an electrical fuse having a fusible element, the improvement comprising:

the fusible element comprising carbon glass having a negligible insertion loss so that the fuse has substantially no impact on electrical characteristics of a circuit in which it is used; wherein the carbon glass glows as current passing through the fusible element approaches a limit of the fuse, thereby giving a visual indication thereof.

6. An electrical fuse comprising a fusible element comprising carbon glass having a negligible insertion loss so that the fuse has substantially no impact on electrical characteristics of a circuit in which it is used; and a pair of ohmic contacts attached to the fusible element; wherein the carbon glass glows as current passing through the fusible element approaches a limit of the fuse, thereby giving a visual indication thereof.

7. An electrical fuse comprising a fusible element comprising carbon glass having a negligible insertion loss so that the fuse has substantially no impact on electrical characteristics of a circuit in which it is used; and a pair of ohmic contacts attached to the fusible element; wherein the carbon glass has a substantially hourglass shape.

* * * * *